United States Patent [19]

Esposito et al.

[11] 4,299,739

[45] Nov. 10, 1981

[54] USE OF ALUMINUM SALTS IN LAUNDRY DETERGENT FORMULATIONS

[75] Inventors: Michael A. Esposito; Henricus M. Princen, both of Cresskill, N.J.

[73] Assignee: Lever Brothers Company, New York, N.Y.

[21] Appl. No.: 826,422

[22] Filed: Aug. 22, 1977

Related U.S. Application Data

[63] Continuation of Ser. No. 670,201, Mar. 25, 1976, abandoned, which is a continuation of Ser. No. 571,185, Apr. 24, 1975, abandoned, which is a continuation of Ser. No. 452,090, Mar. 18, 1974, abandoned, which is a continuation of Ser. No. 246,002, Apr. 20, 1972, abandoned.

[51] Int. Cl.[3] ..... C11D 3/04; C11D 3/10

[52] U.S. Cl. ..... 252/545; 252/89.1; 252/133; 252/174.14; 252/174.21; 252/547; 252/558

[58] Field of Search ..... 252/89, 99, 109, 133, 252/135, 175, 180, 181, 539, 540, 550, 89.1, 174.14, 174.21, 545, 547

[56] References Cited

U.S. PATENT DOCUMENTS

| | | | |
|---|---|---|---|
| 383,853 | 6/1888 | Belcher | 252/133 |
| 474,262 | 5/1892 | Odell | 252/133 |
| 1,633,213 | 6/1927 | King | 252/99 |
| 1,829,522 | 10/1931 | Kern | 252/133 |
| 1,935,834 | 11/1933 | Draisbach | 252/135 |
| 2,220,950 | 11/1940 | Bird | 252/181 X |
| 2,571,690 | 10/1951 | Dobblemann | 252/133 |
| 2,766,212 | 10/1956 | Grifo | 252/551 X |
| 3,011,977 | 12/1961 | Raecke | 252/538 X |
| 3,055,837 | 9/1962 | Wittwer | 252/121 X |
| 3,255,117 | 6/1966 | Knapp | 252/99 |
| 3,308,067 | 3/1967 | Diehl | 252/550 |
| 3,590,001 | 6/1971 | Taylor | 252/539 X |
| 3,686,098 | 8/1972 | Weil | 252/550 |
| 3,801,511 | 4/1974 | Lemoff | 252/135 |

*Primary Examiner*—Dennis L. Albrecht
*Attorney, Agent, or Firm*—Melvin H. Kurtz

[57] ABSTRACT

An improved detergent composition containing as essential ingredients:

(a) a surface active agent;

(b) alkali metal carbonates; and (c) water-soluble inorganic aluminum compounds.

12 Claims, No Drawings

USE OF ALUMINUM SALTS IN LAUNDRY DETERGENT FORMULATIONS

This is a continuation of application Ser. No. 670,201, filed Mar. 25, 1976, now abandoned, which is a continuation of application Ser. No. 571,185 filed Apr. 24, 1975, now abandoned, which is a continuation of application Ser. No. 452,090 filed Mar. 18, 1974, now abandoned, which in turn is a continuation of application Ser. No. 246,002 filed Apr. 20, 1972, also abandoned.

DESCRIPTION OF THE INVENTION

The present invention is directed to detergent compositions which contain as essential ingredients a surface active agent, an alkali metal carbonate builder, and a water-soluble aluminum compound.

It is well known that detergent compositions containing alkali metal carbonates as the primary or sole detergent builder are generally not as effective for laundry purposes as similar compositions wherein the primary or sole builder is a sequestering agent such as sodium tripolyphosphate.

It has now been found that the effectiveness of certain detergent compositions built with alkali metal carbonates can be increased by including water-soluble aluminum salts in the formulation. This increase in effectiveness referred to hereinafter as "the aluminum effect" is particularly noted in so-called carbonate built detergent compositions containing an active system based on nonionic surface active agents, although appreciable benefits will also be afforded to active systems based on anionic and zwitterionic surfactants.

Thus the detergent compositions of the present invention may be described as detergent compositions which contain as essential ingredients based on the total weight of the composition:

(a) about 5% to about 50% (preferably about 10% to about 30%) of a detergent active selected from the group consisting of nonionic, anionic and zwitterionic surface active agents;

(b) about 10% to about 80% (preferably about 20% to about 60%) of an alkali metal carbonate; and (c) about 0.1% to about 20% (preferably about 0.5% to about 5%) of a water-soluble inorganic aluminum compound.

Although the detergent compositions of the present invention need only contain the three essential ingredients mentioned above, other ingredients normally found in standard detergent formulations may be present. Thus the detergent compositions of the present invention may also contain the following ingredients, some of which may be present in major amounts:

- 0–55% of an inert filler, such as sodium sulfate and sodium chloride;
- 0–40% of a silicate, such as sodium silicate or sodium metasilicate having a $Na_2O:SiO_2$ ratio of 1:1 to 1:2.4;
- 0–2% of a perfume;
- 0–40% of a bleaching agent, such as sodium perborate;
- 0–2% of an optical brightener;
- 0–3% of anti-caking agents;
- 0–5% of suds boosters or suds depressants;
- 0–5% of antiredeposition agents; and up to about 85% water when liquid detergent compositions are desired.

Considering the three essential components of the compositions of the present invention, the surfactant system may comprise a nonionic, anionic or zwitterionic surfactant. The species of the nonionic, anionic or zwitterionic surface active agent employed is immaterial in obtaining the aluminum effect noted in the invention and the particular selection will be made on the basis of desired performance with respect to detergency, foaming, processing characteristics, etc.

An important class of nonionics that may be employed comprise a well-known class of nonionic synthetic detergents available on the market under the trade name of "Neodols and Tergitols". This group of nonionics represents the condensation product of primary or secondary aliphatic alcohols having from 8 to 18 carbon atoms, in either straight chain or branched chain configuration, with ethylene oxide, e.g., an alcohol-ethylene oxide condensate having from 3 to 30 moles of ethylene oxide per mole of alcohol, the alcohol fraction having from 10 to 18 carbon atoms.

Other suitable nonionic synthetic detergents include:

(1) The polyethylene oxide condensates of alkylphenols, e.g., the condensation products of alkylphenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkylphenols. The alkyl substituent in such compounds may be derived from polymerized propylene, diisobutylene.

(2) Those derived from the condensation of ethylene oxide with the product resulting from the reaction of propylene oxide and ethylenediamine. For example, compounds containing from about 40% to about 80% polyoxyethylene by weight and having a molecular weight of from about 5,000 to about 11,000 resulting from the reaction of ethylene oxide groups with a hydrophobic base constituted of the reaction product of ethylene diamine and excess propylene oxide, said hydrophobic base having a molecular weight of the order of 2,500 to 3,000 are satisfactory.

(3) Those compounds formed by condensing ethylene oxide with a hydrophobic base formed by the condensation of propylene oxide with propylene glycol. The hydrophobic portion of the molecule thus has a molecular weight of from about 1,500 to 1,800 and a polyoxyethylene content up to about 50% of the total weight of the condensation product.

(4) Long chain tertiary amine oxides.

(5) Long chain tertiary phosphine oxides.

Still another important class that may be utilized includes the betaine surface active agents. These include $C_6$–$C_{18}$ acyl amidopropyldimethyl ammonium acetic acid betaines such as coconut oil fatty acyl and tallow oil fatty acyl amidopropyldimethyl ammonium acetic acid betaines; $C_6$–$C_{18}$ alkyl dimethyl ammonium acetic acid betaines, such as lauryl, myristyl, palmityl and stearyldimethyl ammonium acetic acid betaines; $C_6$–$C_{18}$ acyldimethyl ammonium propane betaines, such as coconut oil fatty acyl and tallow oil fatty acyldimethyl ammonium propane sulfone acid betaines; and $C_6$–$C_{18}$ alkyl dimethyl ammonium propanesulfonic acid betaines, such as lauryl, myristyl, cetyl and stearyldimethyl ammonium propane sulfonic acid betaines. Also included are sulfobetaines of the type disclosed in U.S. Pat. No. 3,280,179 incorporated by reference as well as sulfobetaines, such as hexadecyl and tetradecyl pyridino sulfobetaine and hexadecyl and tetradecyl α-picolino sulfobetaine. Other zwitterionic surface active agents may be similarly employed.

Important examples of the anionic synthetic detergents which form a part of the compositions of the present invention are the sodium or potassium straight or branched alkyl sulfates especially those obtained by sulfating the higher alcohols ($C_8$–$C_{18}$ carbon atom), sodium or potassium $C_9$–$C_{20}$ straight or branched alkyl benzenesulfonates, soaps (i.e., alkali metal, ammonium and alkylolammonium salts of $C_{10}$–$C_{20}$ fatty acids) and $C_8$–$C_{18}$ α-olefin sulfonates.

A more comprehensive list and description of the above-mentioned surfactants will be found in U.S. Pat. Nos. 3,584,035; 3,308,067; and 3,557,003 as hereby incorporated by reference.

The aluminum compounds which are responsible for the "aluminum effect" noted in the compositions described above are those inorganic compounds which are soluble in water and thus capable of furnishing aluminum ions to the wash solution during the wash cycle. Of particular importance are the water-soluble inorganic aluminum salts such as aluminum sulfate, aluminum chloride, aluminum bromide, aluminum chlorate, aluminum citrate and acetate, aluminum iodide, aluminum nitrate, aluminum alkali metal and ammonium sulfates as well as the alkali metal aluminates and hydrates of the aforementioned.

As previously indicated, on a weight basis the aluminum salts will be present in an amount ranging from about 0.1% to about 15% depending on the particular aluminum salt employed. However, since the contributing factor responsible for the aluminum effect is the presence of aluminum ions available to the solution during the wash cycle, the amount of aluminum necessary is best expressed in terms of moles of aluminum available. It has been found that the aluminum effect is particularly pronounced when there is present in the wash solution from about $1\times10^{-5}$ to about $5.0\times10^{-4}$ (preferably about $4\times10^{-5}$ to about $2\times10^{-4}$) moles of dissolved aluminum per liter. Thus considering an individual aluminum compound and the desired use level of the detergent composition, the exact amount of the aluminum compound may be readily calculated by those skilled in the art.

To illustrate the aluminum effect on detergent compositions containing an alkali metal carbonate as a builder, formulations based on nonionic, anionic and zwitterionic surface active systems were prepared with and without an aluminum salt. The compositions were tested under simulated use conditions as follows:

(a) Soiled (vacuum cleaner dust) test cloths were placed in a Terg-O-Tometer containing 1 liter of hard water (180 ppm, expressed as $CaCO_3$, with Ca to Mg ratio of 2:1) at 50° C.;

(b) The detergent formulation to be tested was introduced in an amount sufficient to provide a use level of 1.5 g/liter;

(c) After washing, rinsing and drying, the final reflectances were read on a Gardner Color Difference Meter and compared with the initial reflectance. Tables 1–6 set forth the results obtained wherein compositions of the invention were subjected to the aforementioned test. In each and every instance the presence of aluminum salt improved detergency as evidenced by the increase in reflectancy. Table 7 illustrates the invention with respect to a variety of aluminum salts.

TABLE 1

| | A | | B |
|---|---|---|---|
| Nonionic[1] | 10 | | 10 |
| $Na_2CO_3$ | 60 | | 60 |
| $Al_2(SO_4)_3 \cdot 18H_2O$ | 0 | | 3 |
| Water | 10 | | 10 |
| $Na_2SO_4$[2] | ← | Balance to 100% | → |
| Initial reflectance (%) | 36.0 | | 36.0 |
| Final reflectance (%) | 51.4 | | 59.6 |

[1]A $C_{14}$–$C_{15}$ linear primary alcohol condensed with an average of 11 moles of ethylene oxide
[2]Inert filler

TABLE 2

| | A | | B |
|---|---|---|---|
| Nonionic[1] | 10 | | 10 |
| $Na_2CO_3$ | 60 | | 60 |
| $Al_2(SO_4)_3 \cdot 18H_2O$ | 0 | | 3 |
| Water | 10 | | 10 |
| $Na_2SO_4$ | ← | Balance to 100% | → |
| Initial reflectance (%) | 31.0 | | 31.0 |
| Final reflectance (%) | 47.2 | | 52.8 |

[1]$C_{11}$–$C_{15}$ mixed linear and secondary alcohol condensed with an average of 7 moles of ethylene oxide

TABLE 3

| | A | | B |
|---|---|---|---|
| LAS[1] | 20 | | 20 |
| $Na_2CO_3$ | 50 | | 50 |
| $Al_2(SO_4)_3 \cdot 18H_2O$ | 0 | | 3 |
| Water | 10 | | 10 |
| $Na_2SO_4$ | ← | Balance to 100% | → |
| Initial reflectance (%) | 31.8 | | 31.8 |
| Final reflectance (%) | 55.2 | | 57.4 |

[1]$C_{12}$–$C_{14}$ linear alkylbenzene sulfonate

TABLE 4

| | A | | B |
|---|---|---|---|
| Amine oxide[1] | 10 | | 10 |
| $Na_2CO_3$ | 60 | | 60 |
| $Al_2(SO_4)_3 \cdot 18H_2O$ | 0 | | 3 |
| Water | 10 | | 10 |
| $Na_2SO_4$ | ← | Balance to 100% | → |
| Initial reflectance (%) | 30.4 | | 30.4 |
| Final reflectance (%) | 53.0 | | 56.7 |

[1]Myristyl dimethyl amine oxide

TABLE 5

| | A | | B |
|---|---|---|---|
| zwitterionic[1] | 10 | | 10 |
| $Na_2CO_3$ | 60 | | 60 |
| $Al_2(SO_4)_3 \cdot 18H_2O$ | 0 | | 3 |
| Water | 10 | | 10 |
| $Na_2SO_4$ | ← | Balance to 100% | → |
| Initial reflectance (%) | 33.0 | | 33.0 |
| Final reflectance (%) | 49.1 | | 52.0 |

[1]Cocodimethylsulfopropyl betaine

TABLE 6

| | A | B |
|---|---|---|
| Soap[1] | 40 | 40 |
| $Na_2CO_3$ | 50 | 50 |
| $Al_2(SO_4)_3 \cdot 18H_2O$ | 0 | 3 |
| Water | 10 | 7 |
| Initial reflectance (%) | 32.0 | 32.0 |
| Final reflectance | 52.8 | 61.5 |

[1]80/20 tallow/coco soap

TABLE 7

| | A | B | C | D |
|---|---|---|---|---|
| Nonionic[1] | 10 | 10 | 10 | 10 |
| $Na_2CO_3$ | 60 | 60 | 60 | 60 |
| $AlCl_3 \cdot 6H_2O$ | — | 2.2 | — | — |
| $KAL(SO_4)_2 \cdot 12H_2O$ | — | — | 4.3 | — |
| $NaAlO_2$ | — | — | — | 0.75 |
| Water | 10 | 10 | 10 | 10 |
| $Na_2SO_4$ | ← | Balance to 100% | | → |
| Initial reflectance (%) | 31.8 | 31.8 | 31.8 | 31.8 |
| Final reflectance (%) | 47.8 | 50.2 | 50.1 | 51.0 |

[1]A $C_{14}$–$C_{15}$ linear primary alcohol condensed with an average of 11 moles of ethylene oxide It should be understood that the above examples represent illustrations of the invention and should not be deemed as limitations thereof.

The term "alkali metal" as used herein above and in the claims refers preferably to sodium and potassium but does not exclude lithium, rubidium and cesium.

What is claimed is:

1. A laundry detergent composition consisting essentially of, based on the total weight of the composition:

(a) 5% to about 50% of a detergent active of nonionic or zwitterionic surface active agent or mixtures thereof;

(b) 10% to about 80% of an alkali metal carbonate;

(c) 0.1% to about 5% of a water-soluble inorganic aluminum compound of aluminum sulfate, aluminum chloride, aluminum bromide, aluminum chlorate, aluminum iodide, aluminum nitrate, or hydrates thereof; and 0 to 55% of a filler of sodium sulfate or sodium chloride.

2. The composition of claim 1 wherein:

(a) said detergent active is present in an amount ranging from about 10% to about 30%; and (b) said alkali metal carbonate is present in an amount ranging from about 20% to about 60%.

3. The composition of claim 2 wherein the detergent active is a nonionic surface active agent.

4. The composition of claim 2 wherein the detergent active agent is a zwitterionic surface active agent.

5. The composition of claim 2 wherein said inorganic compound is aluminum sulfate.

6. The composition of claim 2 wherein said inorganic compound is aluminum chloride.

7. The composition of claim 2 wherein said inorganic compound is aluminum nitrate.

8. The composition of claim 2 wherein said detergent active is a sulfobetaine.

9. The composition of claim 2 wherein said detergent active is an amine oxide.

10. The composition of claim 2 wherein said alkali metal carbonate is sodium carbonate.

11. The composition of claim 2 wherein said alkali metal is potassium carbonate.

12. The composition of claim 2 wherein said detergent active is a $C_{11}$–$C_{15}$ linear primary or a mixed linear and secondary alcohol condensed with an average of 7–11 moles of ethylene oxide.

* * * * *